United States Patent [19]

Allen

[11] 4,398,370

[45] Aug. 16, 1983

[54] SINGLE LINE CONTROL UNIT FOR MODEL AIRCRAFT

[76] Inventor: Joe R. Allen, Rte. 2, Box 1655, Paulding, Ohio 45879

[21] Appl. No.: 307,666

[22] Filed: Oct. 1, 1981

Related U.S. Application Data

[63] Continuation-in-part of Ser. No. 133,300, Mar. 24, 1980, abandoned.

[51] Int. Cl.[3] ..... A63H 27/04

[52] U.S. Cl. ..... 46/77; 46/51

[58] Field of Search ..... 46/77, 51, 47; 273/26 R, 319, 329, 413, 414, 46

[56] References Cited

U.S. PATENT DOCUMENTS

| | | | |
|---|---|---|---|
| 2,416,805 | 3/1947 | Walker | 46/77 |
| 2,547,776 | 4/1951 | Rankin | 46/51 X |
| 2,593,979 | 4/1952 | Calhoun | 46/77 UX |
| 2,947,108 | 8/1960 | Dodd, Jr. et al. | 46/77 |

*Primary Examiner*—Mickey Yu

*Attorney, Agent, or Firm*—Harvey B. Jacobson

[57] ABSTRACT

A single line control unit to control the flight movement of a model aircraft attached onto the end of a single control line tethered to a fishing rod assembly comprises a hollow tube slidably mounted about the control line between the handle and the first eyelet of the fishing rod assembly. The control line is preferably secured to a casting reel positioned between the handle of the fishing rod and the control unit. The control unit enables the user to provide the desired amount of leverage and tension on the control line and thus control the model aircraft movement to and from the rod and allow the aircraft to be manipulated into executing a variety of stunts. The control unit is provided with an internal bearing surface on each end to prevent the control line from wearing the interior surface of the control unit. Further, the single line control assembly may include a weighted member attached to the control line at a position approximate the model aircraft to cause the model aircraft to roll upon proper manipulation of the control unit.

6 Claims, 6 Drawing Figures

12
44
16
31
28
10
18
30
20
22
32
26
24
14

30
34
32
20
34
16
22
24

4
32
4
34
42
16

32
36
16
34
38
40

54
52
48
46
50
44

60
58
56

SINGLE LINE CONTROL UNIT FOR MODEL AIRCRAFT

CROSS-REFERENCE TO RELATED APPLICATION

This application is a continuation-in-part of my application Ser. No. 133,300, filed Mar. 24, 1980, now abandoned.

BACKGROUND OF THE INVENTION

1. Field of the Invention

The present invention relates generally to an amusement device, and in particular to a single line control assembly for use in controlling the flight of lightweight model aircraft tethered to a single control line which is moved by the user.

Specifically, the present invention relates to a novel and improved control unit for increasing the control the user has on the flight movement of lightweight model aircraft, such as paper aircraft, tethered to a single control line.

Single line aircraft models are simply lightweight model aircraft, preferably made of paper, which are propelled around a circle by a single line secured to a fishing pole, the flexibility of the fishing pole creating the energy which pulls the aircraft around the circle. A significant problem with flying model aircraft with a single control line is the amount of control a user has over the aircraft movement. Previously, the only possible control a user had over single line model aircraft movement was speed, and the up and down movement of the aircraft. Because of this limitation, methods of flying single line controlled model aircraft have not been as popular as other methods of flying model aircraft.

The difficulty in accurately controlling single line model aircraft, and particular model aircraft which are formed of paper, resides in the nature of the aircraft as well as the variety of interacting forces which exist during the movement of the fishing pole, control line and model aircraft through the air. For example, in instances in which the control line is greatly extended, the control line may weigh as much or more than the model aircraft itself which is formed of paper or other lightweight material. The inherent instability of such a model aircraft is further intensified due to the wind resistance of the control line as it is moved through the air. The shape of the model aircraft is another important factor in the control of the flight path inasmuch as the aerodynamic stability allows the aircraft to fly even when a slack is created in the line and at the same time allows changes in the flight path upon only very slight changes in the tension and movement of the single control line.

In my prior application, a novel control unit for manipulating the flight path of single line model aircraft was disclosed in which the control unit comprised a hollow tube slidably mounted about the control line and which was movable by the user to alter the length of the flight path as well as alter the slack, tension and inherent twisting movement of the control line. This novel control unit greatly improved the control over the flight path of inherently instable lightweight model aircraft and, as such, greatly improved the acceptance of flying model aircraft with a single control line. The present invention includes improvements of the control unit disclosed in my prior application.

2. Description of the Prior Art

Several U.S. Patents that describe methods and means for controlling the flight of model aircraft tethered onto one or more control lines include U.S. Pat. No. 2,416,805, issued Mar. 4, 1947, which discloses a control member for a dual line controlled model aircraft in which the control member is used to vary the effective diameter of the circular course traversed by the aircraft; U.S. Pat. No. 2,947,108, issued Aug. 2, 1960, which discloses a model aircraft attached to a single control line in which the control line is passed through a hollow handle and in which a control ring is attached to an end of the control line, the hollow handle and ring are utilized to control the movement of the model aircraft along with swivel connectors which enable the control line to turn about its longitudinal axis independently of the ring and the aircraft; U.S. Pat. No. 3,919,805, issued Nov. 18, 1975, which discloses improvements in remotely powered and controlled model aircraft wherein the aircraft is propelled by a propeller driven from a remotely located motor through an elongated flexible drive shaft or cable confined within an elongated flexible tube or housing, and further including secondary control means comprising a control knob having a central bore therethrough which knob is slidably and rotatably positioned about the tube and which may be used to shorten the radius of flight of the aircraft; and U.S. Pat. No. 2,561,760, issued July 24, 1951, which discloses a single line controlled aircraft wherein a handle member comprising a hollow tube through which the line is passed is used for control, a section of the line passing outward from the exterior of the hollow tube is attached to the model, the amount of line passed through the tube is controlled by the hand of the user to control the radius of flight. Another patent having a disclosure which teaches a single line control unit for transmitting tortional force to a single control line for flying model aircraft is U.S. Pat. No. 2,558,109, issued June 26, 1951. The disclosures in the above patents are unlike the present invention which comprises a single line control assembly which includes a fishing rod and casting reel assembly and a tubular control unit slidably mounted about the control line. The tubular control unit as disclosed in my prior patent application as well as the improvements disclosed herein take into account all the physical characteristics of a lightweight model aircraft and the interaction of forces which are present during manipulation of the flight of the aircraft to allow the user to accurately manipulate the aircraft into a desired flight path which may include aerial acrobatics. None of the devices disclosed in any of the prior patents relating to this invention have been able to achieve the control of single line aircraft afforded by the present invention.

SUMMARY OF THE INVENTION

The control unit of the present invention overcomes the prior problems associated with flying single line model aircraft. The flying enthusiast or hobbyist is provided greater control over the flight path of the aircraft, making such single line aircraft an enjoyable endeavor. In accordance with the present invention, a lightweight model aircraft is attached to an end of a single control line which is tethered to a fishing rod assembly. The single line control unit of the present invention comprises a hollow tube which is positioned between the handle of the fishing rod which supports the control line and the first eyelet on the fishing rod. The control line passes through the tubular control unit such that the control unit is movable along the control line. Preferably, the fishing rod assembly comprises a casting reel to secure the control line. The control line is tethered or secured to the casting reel which is positioned between the handle of the fishing rod and tubular control unit. The enthusiast is now able to propel the model aircraft around a circle by moving the handle of the fishing rod with one hand and further control the flight movement of the model aircraft by pulling the control unit to shorten the radial distance of the flight path and by moving the control unit along the single control line to change the leverage as well as tension on the control line and thus manipulate the model aircraft into executing numerous aerial acrobatics.

It has been found, however, that while the tubular control unit is capable of controlling the flight path of single line lightweight model aircraft in a manner vastly superior to what has previously been achieved, after excessive use the single control line often wears an uneven groove into each end of the tubular control unit which has resulted in less than adequate control. Accordingly, to alleviate this possible problem the tubular control unit may be provided with bearing surfaces placed at each end of the control unit. The control line rests on the bearing surfaces and can be kept away from the edges of the tubular control unit when desired. Additionally, the single line control assembly of the present invention is provided with a weighted clip member which is attached to the control line between the end of the fishing rod and the model aircraft. The weighted clip with the proper manipulation of the control line enables the model aircraft to move in barrel rolls, snap rolls, climbing and diving spins, all of which has never been possible before without altering the structure of the model aircraft. The weighted clip can be provided with a trailing fin which imparts to the control line twisting forces which have resulted in additional aerodynamic control on the line and the attached model aircraft.

Accordingly, it is a primary object of the present invention to provide an improved single line control assembly for flying lightweight model aircraft which improvement will provide the user with greater control over the flight path of the model aircraft.

It is another object of the present invention to provide an improved control unit for a single line lightweight model aircraft so as to provide the user with greater control over the flight path of the aircraft which is flown without the air of a motor.

It is a further object of the present invention to provide a lightweight model aircraft and an improved control unit therefor for flying the aircraft without the necessity of a motor in which the model aircraft is attached onto the end of a single control line which is tethered to a fishing rod and in which the control unit in the form of a hollow tube is slidably mounted about the control line and which control unit is provided with a bearing surface so as to prevent the control line from excessively wearing the edges of the control unit and thus prevent degradation of control of the model aircraft.

Still yet another object of the present invention is to provide an improved control unit for single line model aircraft in which the control unit can be gripped and manipulated by the hand of the user to control the radial length of flight of the model aircraft and to enable the user to further manipulate the control line so as to cause the aircraft to execute numerous aerial acrobatics.

Still another object of the present invention is to provide a single line control assembly for flying lightweight model aircraft without the aid of a motor in which the assembly includes an accessory to increase the acrobatics which the user can manipulate the aircraft to perform without changing the structure of the model aircraft.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
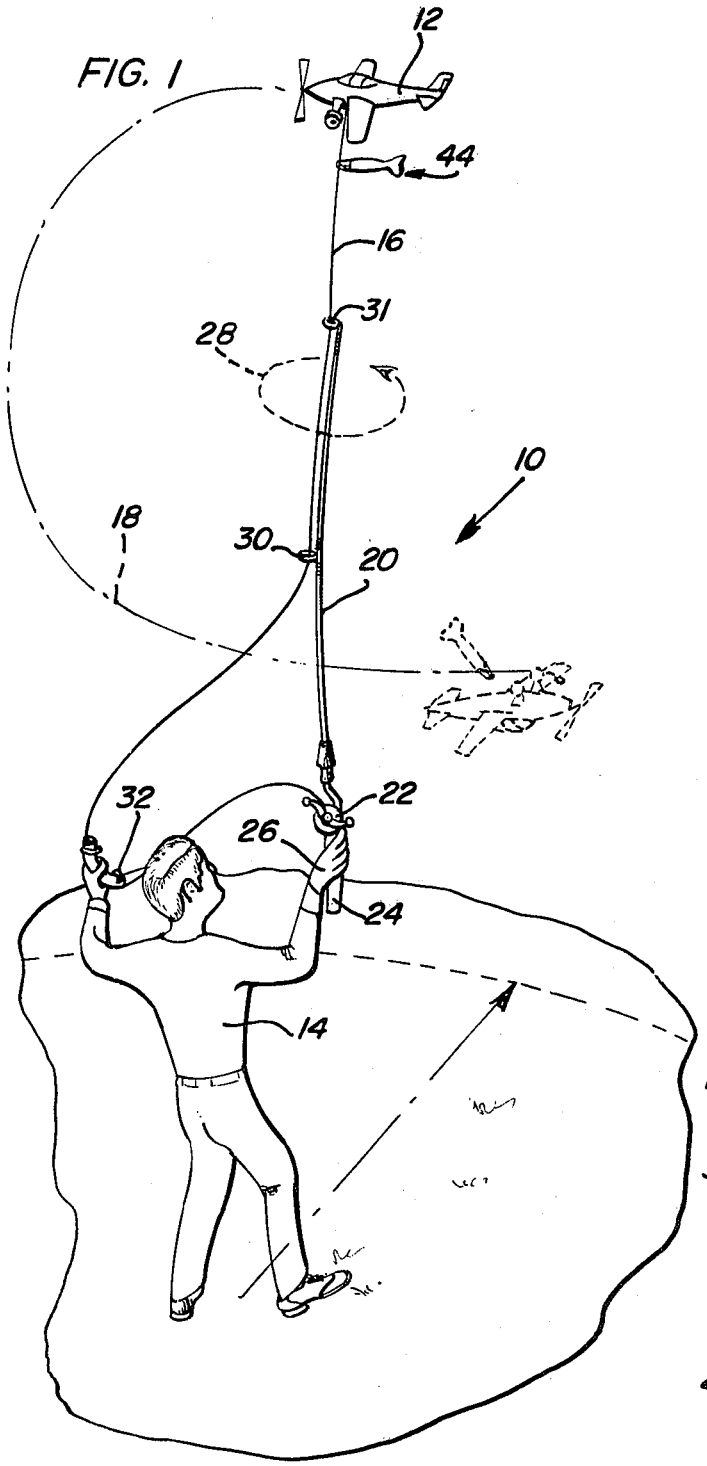
FIG. 1 is a perspective view illustrating the use of the single line control assembly of the present invention and illustrating how the improved control unit of the present invention may be used to control the flight path of the model aircraft, one dotted line showing the movement of the fishing rod as manipulated by the user and the other dotted line illustrating the movement of the model aircraft in a loop.
Figure 2:
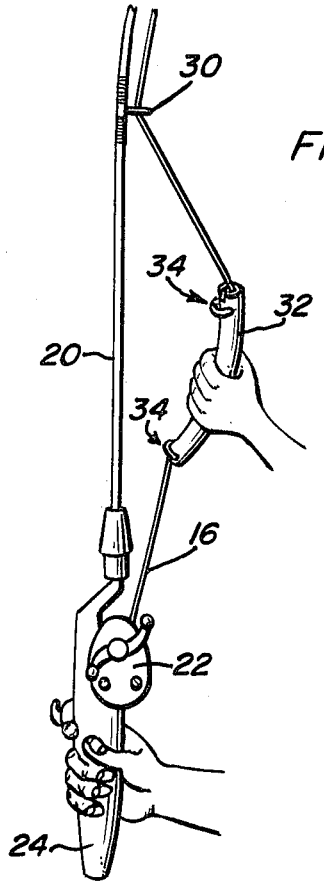
FIG. 2 is a fragmentary perspective view illustrating a more detailed view of a single line control assembly and improved control unit.

Referring to FIGS. 1 and 2, the single line control assembly of the present invention is generally indicated by reference numeral 10 and is used to propel a lightweight model aircraft 12, such as a model airplane about a radius described by the dotted line and arrow at the feet of user 14. Modelaircraft 12 is attached to the end of a single control line 16 and is propelled along the flight path indicated by the dotted line 18 by movement of conventional casting rod 20 containing reel 22 which has secured thereto an end of control line 16 and which enables the user to control the radial distance model aircraft 12 is spaced from the end of fishing rod 20. Due to the flexibility of rod 20, the user only needs to grip handle 24 and revolve wrist 26 slightly to propel model aircraft 12 into the air and around the circular path shown by dotted line 18. The end of the fishing rod 20 revolves in a circular path indicated by reference numeral 28. Primarily, it is the flexibility of fishing rod 20 especially along the end thereof which provides the force to maintain aircraft 12 in the air. Eyelets 30 and 31 enable single control line 16 to remain adjacent rod 20 and further provide leverage on line 16 for increasing the speed of model aircraft 12.

Previously, model aircraft of the type described herein were flown with the single line control assemblies previously described. However, inasmuch as only a limited control over the flight path of the model aircraft was possible, single line control assemblies for flying lightweight model aircraft have not become as popular as other means to fly model aircraft. In accordance with the present invention, single line control assembly 10 is provided with a novel control unit which provides the enthusiast with superior control over the flight path of the aircraft. The improved control unit of the present invention is generally indicated by reference numeral 32 which comprises a hollow tube positioned between the reel 22 and eyelet 30 of rod 20. Control unit 32 is slidably mounted about control line 16 between reel 22 and the first eyelet 30. Control unit 32 can be formed of a rigid plastic or a plastic or similar material which is more flexible allowing the tube to bend as it is gripped by the hand of the user. It has been found that some flexibility provided in control unit 32 is advantageous in allowing greater variation of the drag forces existing between control line 16 and the interior surface of control unit 32.

To use single line control assembly 10 and to fly lightweight model aircraft 12, aircraft 12 is secured to single control line 16 such as by tieing line 16 through a hole in the leading edge of one of the wings at about the center thereof as shown in FIG. 1. Control line 16 is secured to casting reel 22 in the usual manner and is used to control the radius of the flight path. As shown in FIGS. 1 and 2, user 14 holds handle 24 of the casting rod assembly in one hand, and by revolving wrist 26 stiff, but flexive rod 20 is moved about in a small circle as described above. The radius of the flight path will be primarily determined by the amount of line 16 extending from eyelet 31 to model aircraft 12. Control unit 32 is grasped in the other hand and can be moved toward or away from the user to change the radial length of the flight path and may also be twisted, turned and moved forward and back along the control line to alter the tension in control line 16 and thus enable the user to manipulate the aircraft into executing numerous aerial acrobatics such as the loop shown in FIG. 1.

Control unit 32 can manipulate the flight path of aircraft 12 by taking advantage of various physical phenomena. It must be understood that model aircraft 12 is extremely lightweight and is a dynamically stable object as it is moved through the air. A sudden impulse by changing the radial flight length of the control line or manipulating control unit 32 to change the tension on line 16 alters the state of equilibrium of the aircraft. The change from one equilibrium state to another must be controlled by dampening the oscillation of aircraft 12 during the change of equlibrium states. In this context, control unit 32 acts as a dampening mechanism which can slow down or alter the oscillations in control line 16 which are directed to aircraft 12. Because of the ability of control unit 32 to be moved up and down control line 16, the oscillations in control line 16 can be varied. Inasmuch as aircraft 12 is lightweight, very slight changes in the oscillations present in control line 16 will greatly affect the flight path of model aircraft 12. It is the tubular shape of control unit 32 which allows the user to control the sudden oscillation changes in control line 16. Additionally, the control of slack in line 16 also affects the flight path of model aircraft 12. It has been found that a slack area on the control line produces a vortex adjacent thereto as the slack area is moved through the air. The vortices produce a downward force. Control unit 32 thus is able to vary the small vortex forces and place them in different locations in relation to the center of gravity of model aircraft 12. Accordingly, it can be seen that control unit 32 acts not only in changing the mechanical leverage produced in line 16 by lengthening and shortening the amount of line 16 beyond rod 20, but acts further in changing the physical forces intrinsic in line 16 as it moves through the air and which forces greatly affect the movement of a lightweight model aircraft which is tethered onto the control line.

While a plain hollow tube has worked satisfactorily in accurately controlling the flight path of a lightweight model aircraft, after extensive use, the control line often will wear the ends of the control tube producing a roughened or jagged edge which produces too much friction between the control unit and the control line and also alters the effective length of the control unit making it difficult to accurately control the flight movements. Again it must be emphasized that the model aircraft is extremely lightweight and will react to minute changes in the intrinsic forces within the control line.

Figure 3:
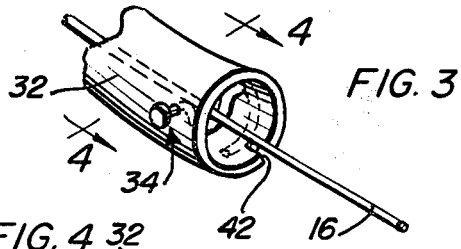
FIG. 3 is a fragmentary perspective view of the improved control unit placed about the control line.
Figure 4:
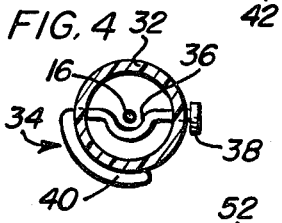
FIG. 4 is a transverse sectional view of the improved control unit taken generally along a plane passing through section line 4—4 of FIG. 3.

Referring to FIGS. 3 and 4, control unit 32 has provided at each end a bearing surface 34 which greatly reduces the amount of contact between control line 16 and the interior surfaces of control unit 32. Each bearing surface 34 includes a bearing trough 36 formed in the interior center of control unit 32. Bearing trough 36 is contoured to receive control line 16 and is the portion of bearing surface 34 which contacts control line 16 during the manipulation of control unit 32. As shown in FIGS. 1 and 2, a pair of bearing surfaces 34 are provided in control unit 32, one at each end thereof. Bearing surface 34 is preferably formed from a straight pin which is inserted entirely through control unit 32 and is permanently secured thereto by means of head 38 abutting the external surface of control unit 32 and bending the opposite end 40 of the pin in conformance to the rounded exterior surface of control unit 32. Bearing trough 36 is also formed by shaping the pin by bending. Of course, other types and configurations of bearing surfaces may be used so long as the control line is kept from constantly rubbing and thus degrading the interior surface of control unit 32. To further prevent the formation of an uneven surface or groove being formed in control unit 32 by the contact of control line 16 against the interior surface of control unit 32, a notch 42 is provided in each end of control unit 32. Notch 42 aids in allowing control unit 32 to move freely about control line 16 without adverse amounts of friction.

Model aircraft 12 is formed of various materials, such as paper, plastic, or other lightweight materials. A preferred model aircraft is an airplane formed from a sturdy paper in which the fuselae and wings in the form of an airplane are cut out in separate top and bottom halves. The two halves are glued together with wire reinforcements spaced between the halves and running along the length of the wings and landing gear which can be bent downward once the halves are fastened together. The propeller can be supported on a pin which is stuck through a block glued to the nose of the craft. A hole is placed in the wing in the desired location described and control line 16 is tied thereto.

Figure 5:
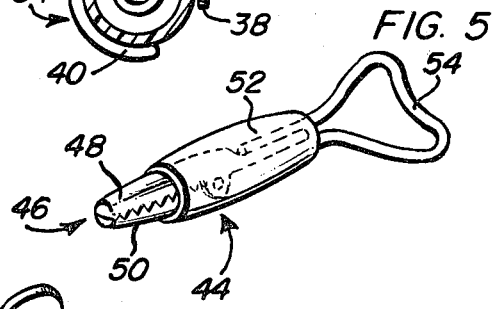
FIG. 5 is a perspective view illustrating an accessory which may be attached to the control line for the purpose of causing the aircraft to roll and spin.

It has been possible to modify the model aircraft, in particular, ones that are made of paper so as produce a rolling and spinning action as the aircraft is manipulated into climbing and diving. Such action can be produced by adding excessive weight on the inside wing of the aircraft and manipulating the control line so as to release the tension, whereby the model aircraft banks toward the operator. In FIG. 5, there is illustrated an accessory which enables the operator to manipulate the model aircraft into the same type of rolls and spins described above without altering the structure of the aircraft. This accessory is generally indicated by reference numeral 44 and it can be characterized as a roll control accessory. Roll control 44 comprises a weight in the form of a clip 46 comprising upper and lower jaws 48 and 50, respectively, a plastic covering 52 which covers a portion of the clip and a rear fin 54 which extends from plastic covering 52. It has been found that the amount of roll which can be produced during a flight of the model aircraft can be controlled by moving and clipping roll control 44 along different positions on control line 16. Roll control 44 produces dynamic instability of aircraft 12 when the tension on control line 16 is released. Additionally, the weight of roll control 44 can be used to snap or pull model aircraft 12 into a desired direction by the operator suddenly whipping rod 20.

Figure 6:
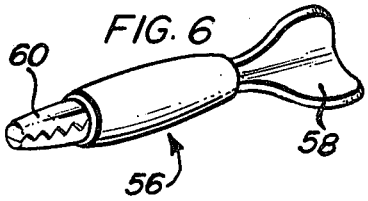
FIG. 6 is a perspective view of an alternative accessory which enables the user to manipulate the aircraft into a series of rolls or spins.

In FIG. 6 is illustrated an alternative roll control indicated by reference numeral 56. Roll control 56 is substantially equivalent to roll control 44 except that the rear fin 58 is solid and comprises a plurality of trailing edges which extend in different planes. Roll control 56 produces minute twisting forces in line 16 which are conveyed to the tethered model aircraft and the control 56 includes a forward clip 60 equivalent to clip 46 of roll control 44.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In an amusement device comprising a model aircraft attached onto the end of a tethered single control line wherein said control line is held to a rod assembly including a reel means and a flexible rod and wherein said rod includes an eyelet placed adjacent the outer end thereof to hold said control line adjacent said rod and apply with said rod leverage to said control line to propel said model aircraft in the air and maintain a flight path, the improvement comprising an elongated hollow tube slidably mounted about said control line between said reel means and said eyelet, said hollow tube being controllable by hand to control the flight path of said model aircraft, said hollow tube further comprising an interior bearing means contacting said control line passing through said hollow tube, said bearing means being provided adjacent each end of said hollow tube, each of said bearing means comprises an interior trough, said trough being in contact and guiding said control line passing through said hollow tube.

2. In an amusement device comprising a model aircraft attached onto the end of a tethered single control line wherein said control line is held to a rod assembly including a reel means and a flexible rod and wherein said rod includes an eyelet placed adjacent the outer end thereof to hold said control line adjacent said rod and apply with said rod leverage to said control line to propel said model aircraft in the air and maintain a flight path, the improvement comprising an elongated hollow tube slidably mounted about said control line between said reel means and said eyelet, said hollow tube being controllable by hand to control the flight path of said model aircraft, weight means attached to said control line between the outer end of said rod and said model aircraft, said weight means including means to clip said weight means along any portion of said control line between the outer end of said rod and said model aircraft.

3. The improvement of claim 1 wherein said weight means further includes a rear fin.

4. The improvement of claim 3 wherein said fin is solid and comprises a plurality of faces extending in different planes.

5. The improvement of claim 3 wherein said clip means and said fin extend from a covering surrounding a portion of said clip means and said fin.

6. The improvement of claim 5 wherein said covering is plastic.

* * * * *